US005571323A

United States Patent [19]

Duffy et al.

[11] Patent Number: 5,571,323

[45] Date of Patent: Nov. 5, 1996

[54] POWDER SPRAY APPARATUS FOR THE MANUFACTURE OF COATED FASTENERS

[75] Inventors: Richard J. Duffy, Shelby Township; Eugene Sessa, Mt. Clemens, both of Mich.

[73] Assignee: Nylok Fastener Corporation, MaComb, Mich.

[21] Appl. No.: 410,944

[22] Filed: Mar. 27, 1995

Related U.S. Application Data

[63] Continuation of Ser. No. 113,203, Aug. 27, 1993, abandoned.

[51] Int. Cl.[6] ..... B05B 7/14

[52] U.S. Cl. ..... 118/308; 118/310; 118/326; 118/313

[58] Field of Search ..... 118/308, 310, 118/326, 620, 500, 313

[56] References Cited

U.S. PATENT DOCUMENTS

| | | | |
|---|---|---|---|
| 4,120,993 | 10/1978 | Duffy et al. | 427/195 |
| 4,569,161 | 2/1986 | Shipman | 51/436 |
| 4,775,555 | 10/1988 | Duffy | 427/183 |
| 4,815,414 | 3/1989 | Duffy et al. | 118/308 |
| 4,842,890 | 6/1989 | Sessa et al. | 427/598 |
| 5,018,910 | 5/1991 | Weiss | 406/144 |
| 5,078,083 | 1/1992 | DiMaio et al. | 118/308 |
| 5,090,355 | 2/1992 | DiMaio et al. | 118/681 |
| 5,090,626 | 2/1992 | Platsch | 239/654 |
| 5,138,972 | 8/1992 | Glanzmann | 118/699 |
| 5,141,375 | 8/1992 | Pollizzi | 411/369 |
| 5,169,621 | 12/1992 | DiMaio et al. | 118/322 |
| 5,221,170 | 6/1993 | Duffy et al. | 411/428 |

FOREIGN PATENT DOCUMENTS

| | | |
|---|---|---|
| 0121483 | 8/1976 | Germany . |
| 3811309 | 10/1989 | Germany . |
| 1593443 | 7/1981 | United Kingdom . |
| 2218012 | 9/1991 | United Kingdom . |

*Primary Examiner*—James C. Housel
*Assistant Examiner*—Rachel Heather Freed
*Attorney, Agent, or Firm*—Niro, Scavone, Haller & Niro

[57] ABSTRACT

An apparatus for generating a powder stream to be applied to a work piece includes a powder reservoir, a mixing chamber, a powder metering valve, a transfer conduit, and a nozzle. The metering valve allows control of the powder flow from the reservoir into the mixing chamber where it is dispersed with and entrained in an air flow entering the chamber through an aspirating inlet. The air entrained powder is then conveyed from the mixing chamber via the transfer conduit to the nozzle. The nozzle includes a controllable gas flow input and a powder stream generating passageway configured and associated with the transfer conduit to generate a reduced pressure in the conduit and mixing chamber which draws the air borne powder from the chamber into the nozzle. One or more of the individual components are adjustable to control the size, configuration, thickness or other parameters of the coating on the work piece as a result of the applied powder stream.

15 Claims, 3 Drawing Sheets

POWDER SPRAY APPARATUS FOR THE MANUFACTURE OF COATED FASTENERS

This is a continuation of copending application Ser. No. 08/113203 filed on Aug. 27, 1993, now abandoned.

BACKGROUND OF THE INVENTION

The present invention relates generally to apparatus for generating a gas-borne powder stream and, more particularly, to apparatus for the application of a powder to a work piece. The invention finds particular utility in the fabrication of threaded devices having a coating of fusible thermoplastic resin.

It is now conventional in the threaded fastener industry to apply various coatings to the threads of fasteners to achieve predetermined performance characteristics. The coating may provide enhanced frictional engagement, or a self-locking function. It may create an adhesive bond between the fastener and a mating threaded device. Other coatings are also used for lubrication, masking and electrical insulation. Often, such coatings are formed by applying a stream of air-borne thermoplastic resin particles onto the fastener which has been preheated to a temperature above the resin's melting point. Upon impact, the resin particles melt and fuse into a coating which will adhere to the fastener when the resin cools and resolidifies.

Examples of prior art apparatus used in the fabrication of such coated threaded devices are disclosed in U.S. Pat. Nos. 4,120,993; 4,775,555; 4,815,414; 4,842,890; 5,090,355; 5,141,375 and 5,221,170.

SUMMARY OF THE INVENTION

The present invention is directed to a improved apparatus for generating a powder stream and for applying the powder stream to a work piece such as a threaded fastener. The apparatus of the present invention provides greater versatility and improved performance as compared with known prior art apparatus. It also results in more precise coating configurations, more uniform coating performance, and tighter coating tolerances. In addition, the apparatus of the present invention allows the use of a wider range of resin powders, including powders with particle sizes less than about 150 microns.

The apparatus of the present invention comprises a powder reservoir, a mixing chamber, a powder metering valve, a transfer conduit and a nozzle. The metering valve provides a control of the powder flow from the reservoir into the mixing chamber where it is dispersed into an air flow entering the chamber through an air aspirating inlet. The air powder mixture is then conveyed from the mixing chamber via the transfer conduit to the nozzle. The nozzle includes a controllable gas flow input and a powder stream generating passageway which are configured and operatively associated with the transfer conduit to generate a reduced pressure in the conduit and mixing chamber. As a result, the air powder mixture is drawn from the chamber into the nozzle. Thus, the gas flow input to the nozzle is the primary energy source for conveying the air and powder from the mixing chamber, through the conduit, and out the discharge port of the nozzle and for generating the gas-borne powder stream.

The apparatus of the present invention may also include a conveyor to move the work piece through the powder stream, a heater to heat the work piece to a temperature above the powder melting point, and a vacuum collector to capture the powder overspray emanating from the nozzle which is not deposited onto the work piece.

In accordance with the present invention, one or more of the individual components are adjustable in order to control the coating size, configuration, thickness, or other coating parameters, as ultimately applied on the threaded device.

BRIEF DESCRIPTION OF THE DRAWINGS

The novel features which are characteristic of the present invention are set forth in the appended claims. However, the invention's preferred embodiments, together with further objects and attendant advantages, will be best understood by reference to the following detailed description taken in connection with the accompanying drawings in which:

DETAILED DESCRIPTION OF THE PREFERRED EMBODIMENT

With reference to the drawings, the apparatus of the present invention is illustrated in one preferred embodiment for the application of an air-borne particulate thermoplastic resin powder onto threaded fasteners. While the illustrated embodiment makes reference to a threaded bolt as the fastener, the present invention is useful in coating a wide variety of fasteners and threaded devices, including, but not limited to, screws, bolts, studs, nuts, collars and the like. Moreover, the present invention may be employed to apply a variety of coatings in the form of a gas-borne powder stream. Such powders may include thermoplastic and thermosetting resins such as nylons, acrylics, epoxies and tetrafluoroethylenes.

Figure 1:
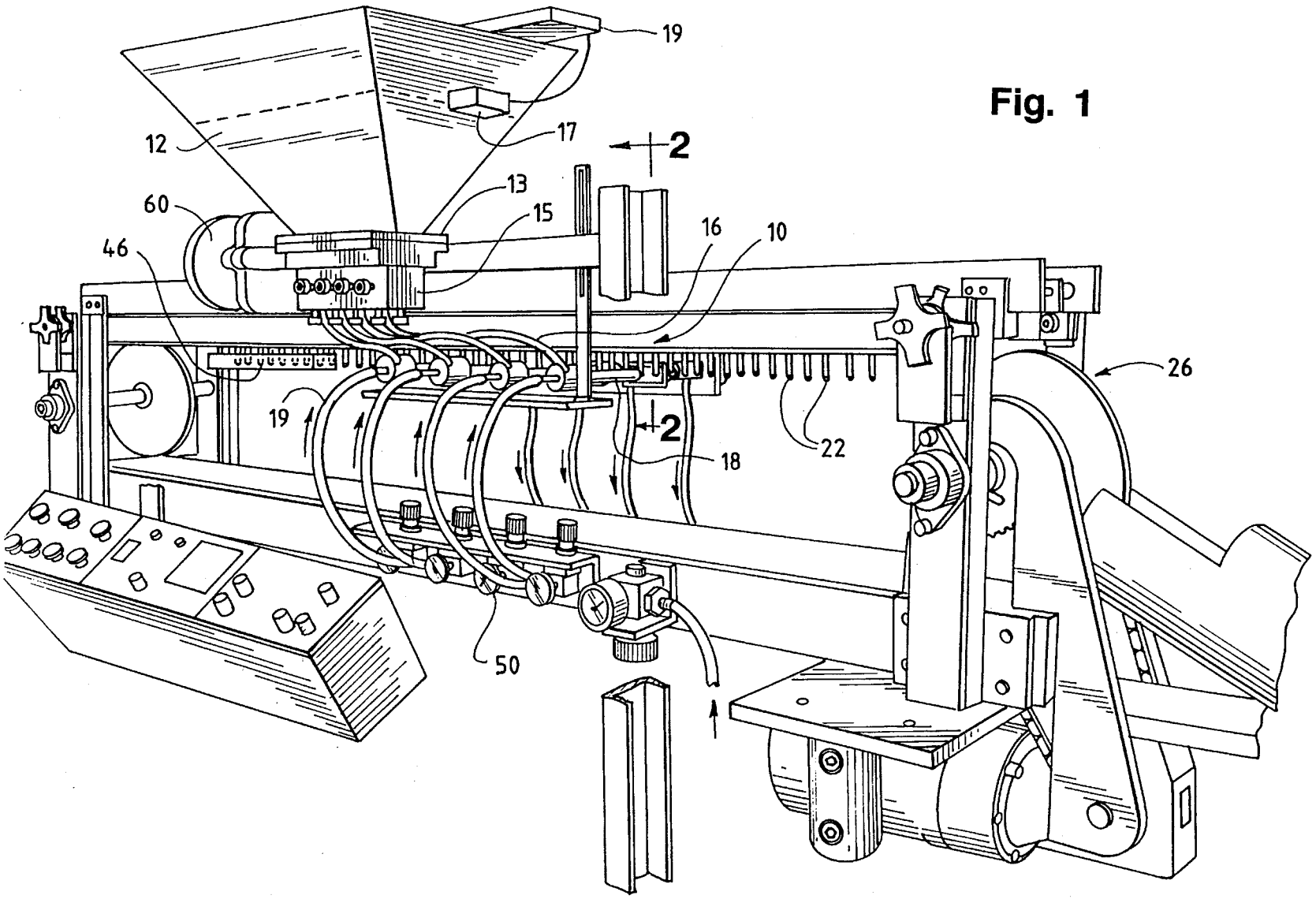
FIG. 1 is a perspective view showing one preferred embodiment of the present invention as used to apply a thermoplastic resin coating onto a plurality of threaded fasteners.

In FIG. 1, a plurality of powder stream generating apparatus are illustrated in conjunction with a fastener mechanical handling system 26. Each powder stream generating apparatus 10 includes a powder reservoir or hopper 12, a mixing chamber 14, a transfer conduit 16 and a nozzle 18. The nozzles 18 are arranged to generate powder streams which are traversed by the fasteners 22 as they are transported by a conveyor designated generally as 26.

Figure 2:
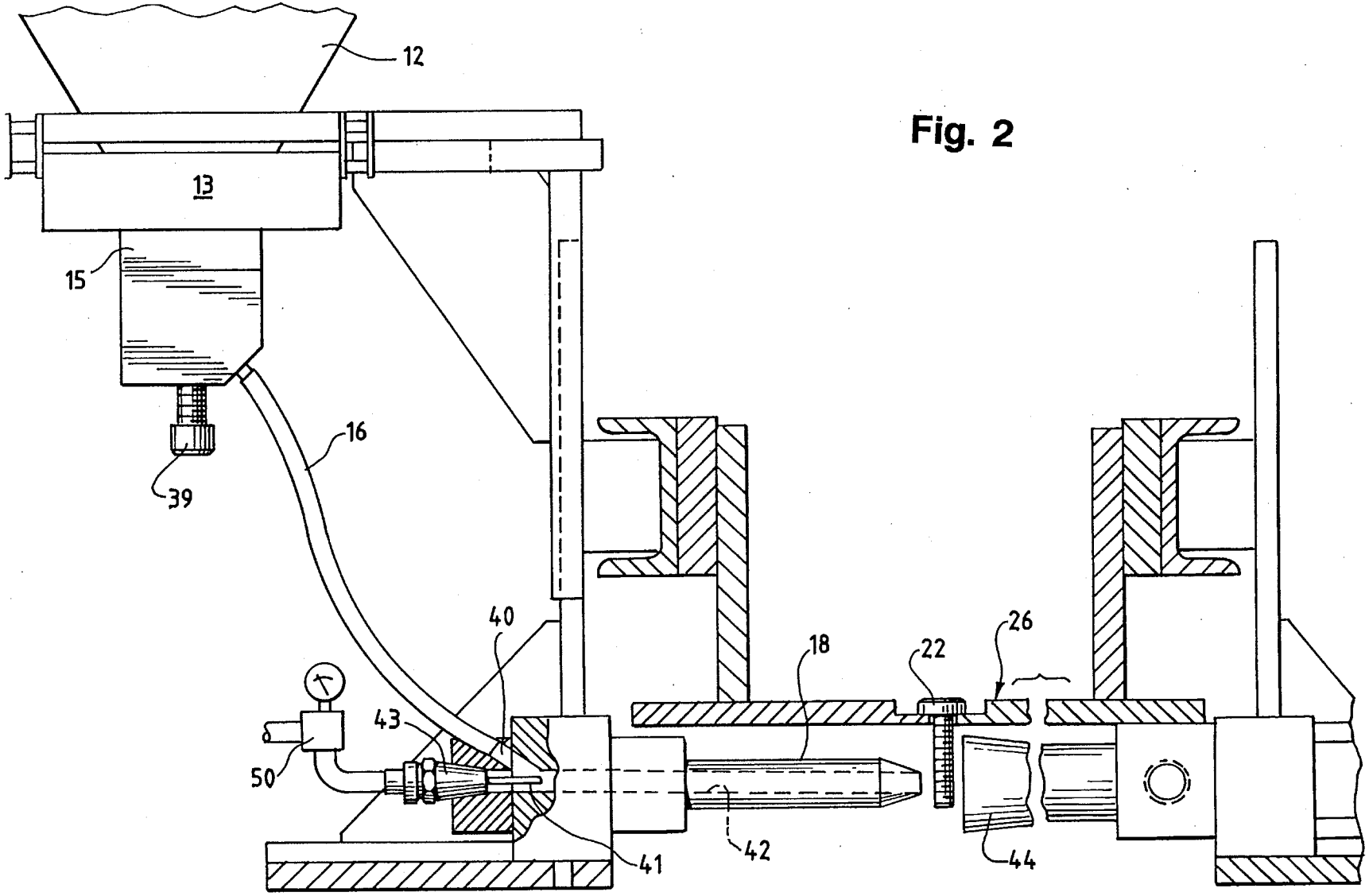
FIG. 2 is cross-sectional view taken along line 2—2 of FIG. 1.
Figure 3:
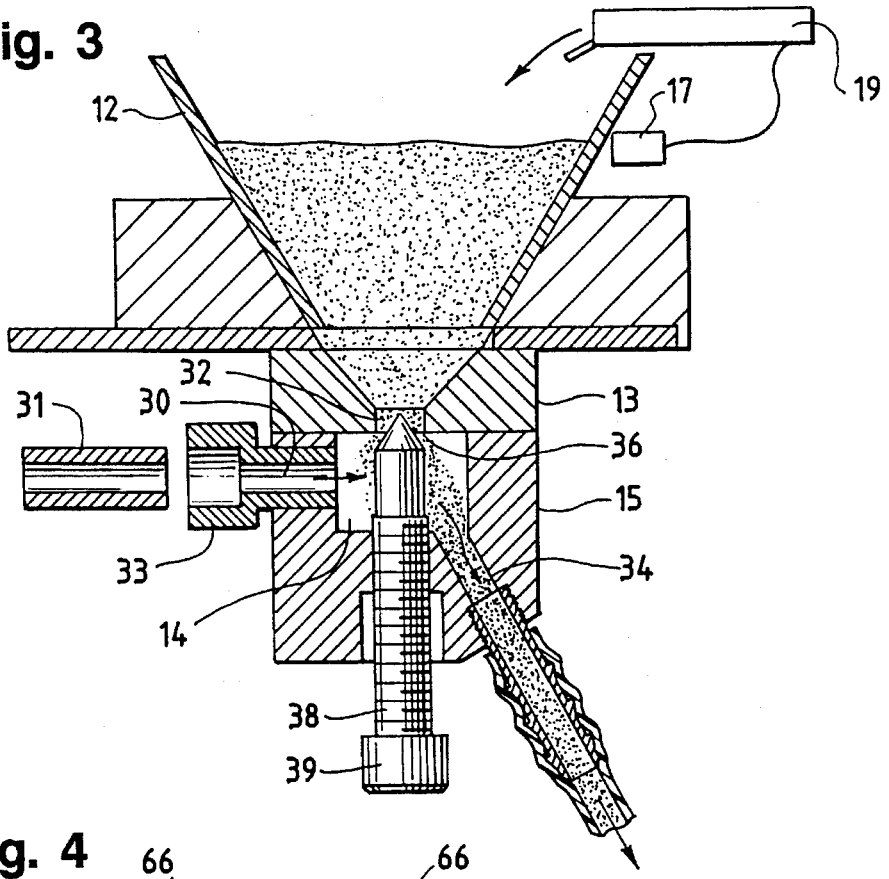
FIG. 3 is a cross-sectional view of one preferred form of mixing chamber and powder metering valve as employed in one preferred embodiment of the present invention.

As shown in greater detail in FIGS. 2 and 3, the apparatus of the preferred embodiment includes a powder divider block 13 which separates the powder into a plurality of powder supplies flowing into a powder metering and mixing housing 15 containing the mixing chambers 14. Each mixing chamber 14 includes an aspirating air inlet 30 and powder inlet 32 and an air powder mixture outlet 34. A powder metering valve comprising valve seat 36 and threaded valve stem 38 permits the controlled delivery of powder from hopper 12 into the mixing chamber. Transfer conduit 16 has one end in communication with the outlet 34 of the mixing chamber and its other end in communication with an air powder input port 40 on nozzle 18. The nozzle also includes a jet orifice 41, a powder stream generating passageway 42 and a controllable gas flow input 43, all of which are configured and operatively associated with the air powder input port 40 to generate a negative pressure within the transfer conduit 16 and mixing chamber 14. Preferably, the nozzle passageway 42 has a substantially uniform cross-section downstream from the air powder input port 40 to minimize back pressure that might otherwise contribute to clogging. Constant cross-sectional area circular passageways having ¼, 5/16 or ⅜ inch internal diameters have been found particularly suitable.

When the apparatus of the present invention is employed to coat heated fasteners, the apparatus also includes a vacuum collector 44 for receiving over spray from the discharged powder stream and a heater 46 (see FIG. 1) positioned to preheat the fasteners to a temperature above the melting temperature of the particulate material comprising the air-borne powder stream.

Figure 4:
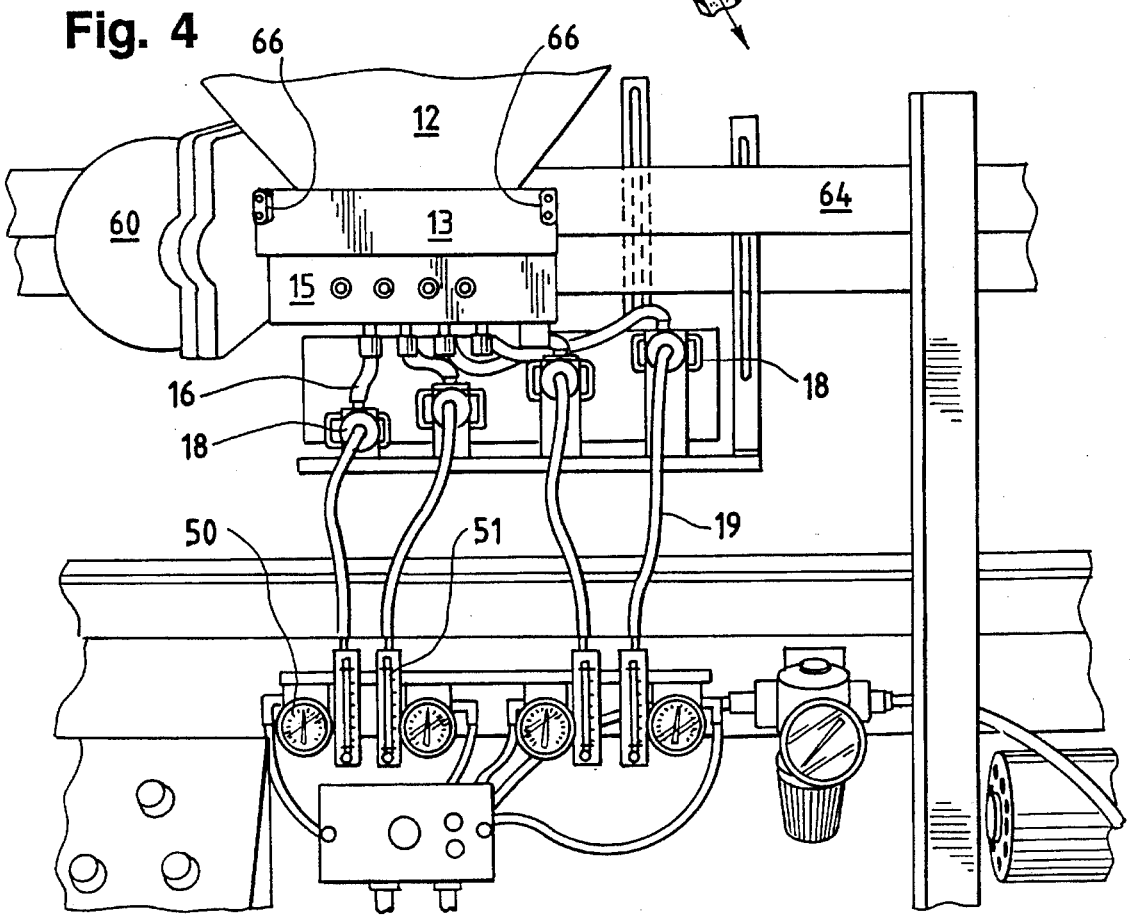
FIG. 4 is a partial side view of the apparatus illustrated in FIG. 1 showing further details of construction and an optional arrangement of nozzles.

As shown in FIG. 4, the nozzles 18 are independently positionable both vertically and horizontally to permit application of coatings of varying dimensions. To that end, the transfer conduit 16 and the conduit 19 for supply of pressurized gas are a flexible plastic tubing.

In accordance with the present invention, independent controls are provided for one or more of the individual components that make up the apparatus. Thus, the hopper 12 may include means for sensing the amount (height, weight or volume) of powder and for maintaining a substantially constant volume of powder in the hopper. For example, a DYNATROL® bulk solids level detection device 17 may be provided. This device will generate an appropriate signal to start and stop an auxiliary powder supply 19 to maintain a constant level of powder in hopper 12. In addition, the powder metering valve includes an external handle 39 that permits adjustment of the powder flow rate into chamber 14. Likewise, aspiration inlet 30 has an adjustable cross-sectional area which is conveniently achieved by use of inserts 31 and/or 33 which have different internal diameters. So too, the gas (typically air) flow input to nozzle 18 is provided with a regulator 50. A regulator is provided for each nozzle 18 and, optionally, flow meters 51 may be utilized as well. Finally, the vacuum collector 44 is preferably constructed using a VACCON® material transfer unit that features an adjustable control to vary the amount of vacuum created.

The use of one or more of these adjustable components in the present invention permits the apparatus to be "fine tuned" to thereby achieve greater precision in the coatings formed by the resulting powder stream. Moreover, it has been found that utilizing a vacuum conveyance technique—transporting the air powder mixture through the mixing chamber and the transfer conduit by creating a negative pressure—enhances more uniform powder flow rates and helps to reduce clogging. Thus, the maintenance of a substantially constant powder level in the reservoir coupled with adjustment of the powder metering valve, the air aspirating inlet and the gas flow input results in the generation and discharge of a powder stream having a substantially uniform flowrate and greater precision in the resin coating on the fastener.

In the operation of the illustrated embodiment, a nylon powder having an average particle size in the range from about 150 microns to 40 microns is metered into hopper 12 and the regulator 50 is opened to generate a pressurized air flow through nozzle passageway 42. The gas flow input terminates in jet orifice 41 which is positioned adjacent to air powder input port 40 thereby generating a reduced pressure in transfer conduit 16 and in chamber 14 as well. It has been determined that a jet orifice having an approximately 0.030-inch internal diameter with a supply pressure of approximately 40 p.s.i. is satisfactory. With the metering valve open, the powder flows by force of gravity (and by air flow through the powder generated from the reduced pressure within chamber 14) from hopper 12 through inlet 32 and into chamber 14 where it is intermixed and entrained in air entering the chamber via aspirating air inlet 30. Powder flow from the hopper is facilitated by use of a conventional vibrator 60, illustrated in FIG. 4, acting on the powder divider block 13. The divider block 13 is reciprocally mounted to frame 64 via links or movable struts 66. Optionally, the vibrator 60 may be provided with adjustable control means to vary the amount of vibration and thereby influence the flow rate of powder into the respective mixing chambers 14.

The air-borne powder is then carried from the mixing chamber 14 via conduit 16 and through nozzle 18 where it is discharged as a relatively coherent stream. As the heated fasteners traverse the powder stream, the individual particles impinge the fastener and are thereby heated and fused to the fastener in the known conventional manner. The particulate overspray is then collected by vacuum collector 44 for reuse.

It has been found in the practice of the present invention that more precise patch shapes and patch boundaries may be achieved. As a result, installation and removal torques for self-locking patch-type fasteners made using the present invention are more uniform.

The degree of adjustability of the disclosed embodiment provides great flexibility in the operation of the invention to achieve enhanced coating performance. For example, it has been found that powder flow rate will increase, with a concomitant increase in fastener torque values, by (a) increasing the supply pressure to gas flow input 43; (b) opening the powder metering valve; or (c) reducing the cross-sectional area of aspirating air inlet 30. Likewise, powder flow rates will generally increase with a decrease in the amount of powder maintained in hopper 12 or by increasing the vibrational action of vibrator 60. Thus, adjustment of one or more of these components will permit fine tuning of the patch performance characteristics. Moreover, with all operational parameters maintained constant, the powder flow rate may be precisely controlled independently for each nozzle by simply adjusting each metering valve by manipulation of each respective control knob 39. In addition, one or more powder streams emanating from nozzles 18 may be independently shut off simply by closing the appropriate metering valve and the associated input air to the particular nozzles. In such circumstances, the remaining powder streams will be unaffected.

It has also been found in the practice of the present invention that more precise patch definition can be achieved by increasing the negative pressure generated by vacuum collector 44.

It is also believed that the use of the circular-shaped nozzle passageway contributes to more precise patch definition. Because the resulting powder stream emanating from this passageway is round, less powder will be applied at the top and bottom of the fastener section that traverses this stream. Hence, patches with thick centers and thinner top and bottom boundaries are obtained with better boundary definition.

It will be appreciated by those skilled in the art that various changes and modifications can be made to the illustrated embodiments without departing from the spirit of the present invention. All such modifications and changes are intended to be covered by the appended claims.

We claim:

1. An apparatus for dispensing powder and generating a powder stream comprising:

a powder reservoir having means for maintaining a substantially constant level of powder within the reservoir;

a mixing chamber;

a passageway extending between said mixing chamber and said reservoir and terminating in a powder inlet to said mixing chamber;

an adjustable powder metering valve, disposed in said powder inlet, for delivering a controlled amount of powder from said reservoir to said mixing chamber;

an aspirating air inlet, disposed in said mixing chamber separate from said powder inlet, for introducing and mixing air with powder in said mixing chamber;

an airborne powder outlet, disposed in said mixing chamber;

a nozzle including a powder stream generating passageway, said passageway having a controllable gas flow input and a separate airborne powder input;

a transfer conduit having one end in communication with an outlet of said mixing chamber and a second end communicating with the airborne powder input to said nozzle; and said controllable gas flow input generating a gas flow within said nozzle passageway and a vacuum within said mixing chamber and said transfer conduit to convey powder to said nozzle; whereby said substantially constant powder level, said powder metering valve, said aspirating air inlet and said controllable gas flow input are operatively associated to generate a substantially uniform powder stream flowrate.

2. The powder dispensing apparatus of claim 1 wherein said powder metering valve is a needle valve.

3. The powder dispensing apparatus of claim 1 wherein said aspirating air inlet is adjustable.

4. The powder dispensing apparatus of claim 1 wherein said controllable gas flow input is adjustable.

5. The powder dispensing apparatus of claim 1 wherein two or more of said powder metering valve, said aspirating air inlet and said controllable gas flow input are independently adjustable.

6. The powder dispensing apparatus of claim 1 wherein said powder metering valve includes an external handle for adjusting the flow of powder from said reservoir into said mixing chamber.

7. The powder dispensing apparatus of claim 1 wherein said powder is directed from said reservoir through said metering valve and into said mixing chamber by gravity and wherein a vibrator is operatively associated with said reservoir to facilitate said gravity flow.

8. The powder dispensing apparatus of claim 1 wherein said nozzle has a bore of substantially round, constant cross-sectional shape and area.

9. An apparatus for dispensing powder and generating a powder stream to be applied to a work piece comprising:

a powder reservoir having means for maintaining a substantially constant level of powder within the reservoir;

a mixing chamber;

a powder passageway extending between said mixing chamber and said reservoir and terminating in a powder inlet to said mixing chamber;

an adjustable powder metering valve, disposed in said powder inlet, for delivering a controlled amount of powder from said reservoir to said mixing chamber;

an adjustable aspirating air inlet, disposed in said mixing chamber separate from said powder inlet; for introducing and mixing air with powder in said mixing chamber;

an airborne powder outlet, disposed in said mixing chamber;

a nozzle, adjacent to said work piece, including a powder stream generating passageway, said passageway having a controllable gas flow input and a separate airborne powder input;

a transfer conduit having one end in communication with an outlet of said mixing chamber and a second end communicating with the airborne powder input to said nozzle;

said controllable gas flow input generating a gas flow within said nozzle passageway and a vacuum within said mixing chamber and said transfer conduit to thereby generate a powder stream discharged from said nozzle passageway and directed toward said work piece; and a vacuum collector positioned adjacent said work piece to receive over spray powder;

whereby said substantially constant powder level, said powder metering valve, said aspirating air inlet and said controllable gas flow input are operatively associated to generate a substantially uniform powder stream flowrate.

10. The powder dispensing apparatus of claim 9 wherein said powder metering valve is a needle valve.

11. The powder dispensing apparatus of claim 9 wherein said controllable gas flow input is adjustable.

12. The powder dispensing apparatus of claim 9 wherein said vacuum collector is adjustable to vary the reduced pressure at the inlet to said collector.

13. The powder dispensing apparatus of claim 9 wherein two or more of said powder metering valve, said aspirating air inlet, said controllable gas flow input and said vacuum collector are adjustable.

14. The powder dispensing apparatus of claim 9 wherein a plurality of powder metering valves, mixing chambers, transfer conduits, nozzles, and vacuum collectors are employed, and at least each of said nozzles is independently positionable relative to a path of travel of said work piece.

15. The powder dispensing apparatus of claim 14 wherein each of said plurality of nozzles is operatively associated with only one powder metering valve, mixing chamber, transfer conduit and vacuum collector.

* * * * *